US005331340A

United States Patent [19]

Sukigara

[11] Patent Number: 5,331,340

[45] Date of Patent: Jul. 19, 1994

[54] THERMAL HEAD WITH CONTROL MEANS FOR MAINTAINING HEAD TEMPERATURE WITHIN A RANGE

[75] Inventor: Akihiko Sukigara, Tokyo, Japan

[73] Assignee: Canon Kabushiki Kaisha, Tokyo, Japan

[21] Appl. No.: 960,287

[22] Filed: Oct. 13, 1992

Related U.S. Application Data

[63] Continuation of Ser. No. 680,038, Mar. 29, 1991, abandoned, which is a continuation of Ser. No. 344,610, Apr. 28, 1989, abandoned.

[30] Foreign Application Priority Data

May 2, 1988 [JP] Japan ..... 63-107600

[51] Int. Cl.[5] ..... B41J 2/325; B41J 2/375

[52] U.S. Cl. ..... 346/76 PH; 347/17

[58] Field of Search ..... 346/76 PH, 1.1; 400/120

[56] References Cited

U.S. PATENT DOCUMENTS 4,704,618 11/1987 Gotoh et al. ..... 346/76 PH 4,710,783 12/1987 Caine et al. ..... 346/76 PH 4,814,787 3/1989 Doi ..... 346/76 PH 4,887,092 12/1989 Pekruhn et al. ..... 346/1.1

*Primary Examiner*—Benjamin R. Fuller

*Assistant Examiner*—Huan Tran

*Attorney, Agent, or Firm*—Fitzpatrick, Cella, Harper & Scinto

[57] ABSTRACT

There is provided a recording apparatus for recording onto a recording paper comprising: a recording head to record onto the recording paper, the recording head having plural heat generating elements; a temperature sensor to detect a temperature; and a controller to ON/-OFF control the heat generation of the heat generating elements in accordance with the detected temperature on the basis of a temperature fluctuation prediction which has experientially and previously been obtained in accordance with recording conditions. The controller controls the heating operation of the heat generating elements by the temperature increase function and temperature decrease function. Thus, the temperature can be held to a value within a range suitable to print and the printing operation can be executed at a high speed.

14 Claims, 8 Drawing Sheets

THERMAL HEAD WITH CONTROL MEANS FOR MAINTAINING HEAD TEMPERATURE WITHIN A RANGE

This application is a continuation of application Ser. No. 07/680,038 filed Mar. 29, 1991, now abandoned and which was a continuation of application Ser. No. 07/344,610 filed Apr. 28, 1989, also abandoned.

BACKGROUND OF THE INVENTION

1. Field of the Invention

The present invention relates to a recording apparatus for recording by causing a plurality of heat generating elements to generate the heat.

Recording apparatuses which can be used in the invention include a printer, a word processor, an electronic typewriter, a facsimile apparatus, a copying apparatus, and the like.

2. Related Background Art

A thermal transfer printer will be described hereinafter as an example of a recording apparatus.

Hitherto, as a heat control system of the thermal transfer printer, a system in which a heat pulse width is controlled by using a thermistor has been known.

That is, a temperature of a print head is measured by the thermistor before printing and a width of heat pulse which is applied to the print head is set on the basis of the temperature value measured, thereby executing the subsequent printing operation by the heat pulse width.

However, in the conventional heat control, the heat pulse width is determined in accordance with the temperature obtained by the thermistor and the printing operation is executed on the basis of the heat pulse width after that. Therefore, when the printing operation is continuously executed, that is, if no white dots exists and black dots are continued, the print head is overheated, so that the heat is accumulated and sometimes printed characters become obscure. Conversely, when the heat is insufficient, the printed characters are partially broken. On the other hand, there is also a problem that erasing characteristics of the character printed when the heat of the print head is accumulated is bad.

To solve the above problems, a system in which the temperature is detected every printing operation by the thermistor and the heat pulse width is controlled is also known. However, this system has a problem in that the high speed printing operation cannot be executed because it takes too much time to detect the temperature.

SUMMARY OF THE INVENTION

It is an object of the present invention to provide a recording method and apparatus which can clearly record.

Another object of the invention is to provide a recording method and apparatus which can record at a high speed.

Another object of the invention is to provide a recording method and apparatus which can prevent the accumulation in heat in a recording head and can maintain the temperature of the recording head within a proper range.

Still another object of the invention is to solve the foregoing conventional problems and to provide thermal transfer printer which can keep the temperature of a print head within a proper range and can print at a high speed.

Yet a further object of the invention is to provide a thermal transfer printer for printing which causes a print head having a plurality of heat generating elements to generate the heat by supplying current to the heat generating elements, wherein the printer has detecting means for detecting the temperature of the print head, and when the printer head executes the printing operation, the heat generating elements are heated for a predetermined time in accordance with a predetermined first function on the basis of the result of the temperature detected by the detecting means, and after the elapse of the predetermined time, the heating operation is interrupted for a predetermined time in accordance with a predetermined second function.

DETAILED DESCRIPTION OF THE PREFERRED EMBODIMENTS

According to an embodiment which will be explained hereinbelow, a print head has a plurality of heat generating elements. These heat generating elements are separately and selectively heated for a heat pulse time obtained by using a predetermined first function, that is, a temperature increase function on the basis of the temperature measured by a temperature detecting thermistor, thereby maintaining the temperature of the heat generating element within a temperature range which is suitable for printing. After the passage of the predetermined heat pulse time, the heating operation is interrupted on the basis of a predetermined second function, that is, a temperature decrease function and the temperature information obtained by this function is stored. When the heating operation is again started, the heat generating elements are heated for the heat pulse time obtained by using the temperature increase function on the basis of the temperature information stored, so that the temperature of the heat generating element is held within a temperature range which is suitable for printing. Since the temperature is detected only once before printing, the thermal transfer printer which can print at a high speed is obtained. In the following discussion of the invention, the operation of a single heat generating element will be described. Those having ordinary skill in the art will appreciate that the other heat generating elements of the print heat will operate in like fashion.

An embodiment of a thermal transfer printer to which the invention is applied will be described in detail hereinbelow with reference to the drawings.

Figure 1:
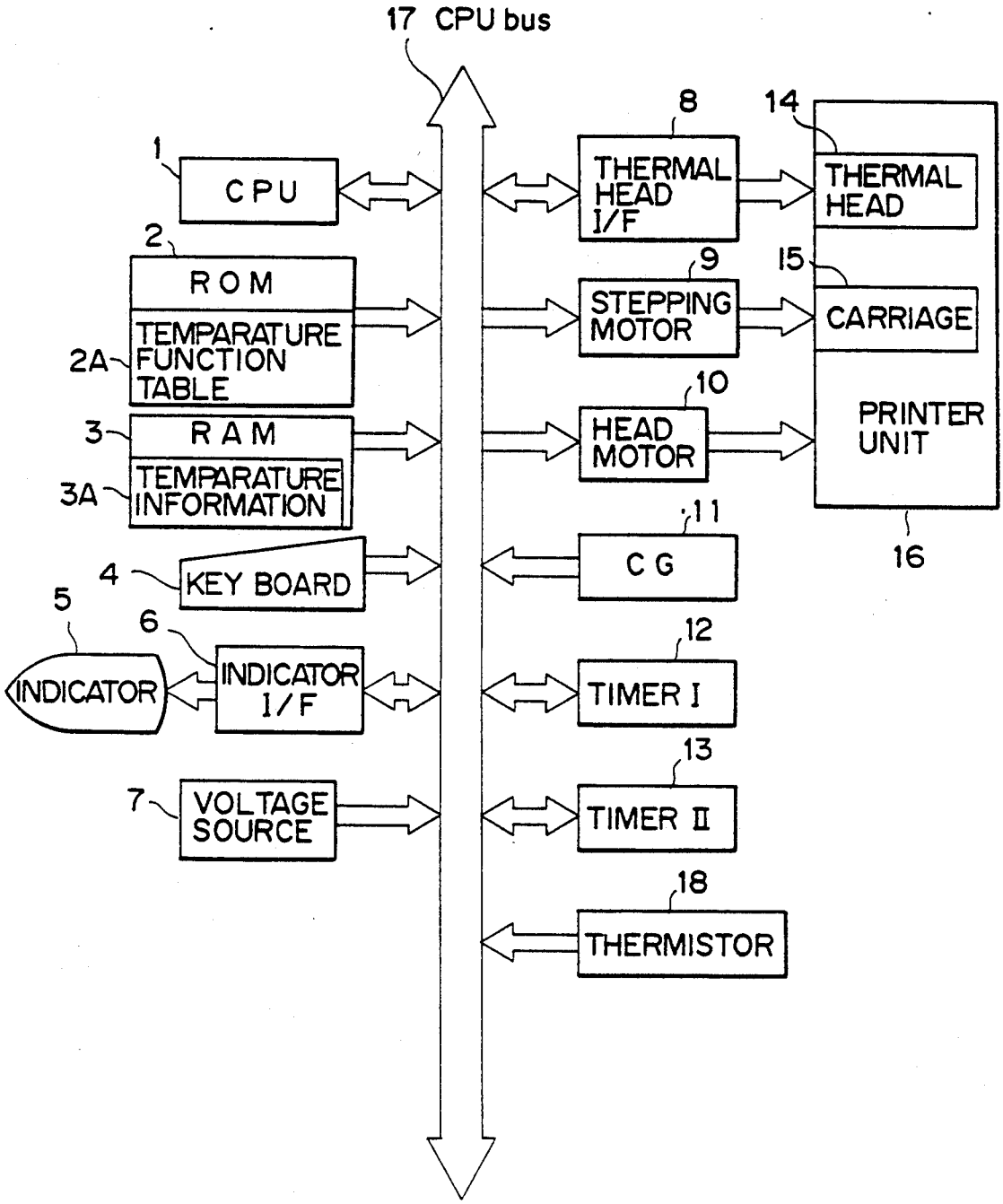
FIG. 1 is a block constructional diagram showing an embodiment of the present invention.

FIG. 1 is a block constructional diagram showing an embodiment of the invention. In the diagram, reference numeral 1 denotes a CPU to control the whole printer; 2 indicates a ROM in which a control sequence, control data, and the like of the CPU 1 are stored; 2A is a temperature function table storing a function as explained hereinlater; 3 denotes a RAM to temporarily store data; 3A denotes an area to store the temperature information in the RAM; 4 denotes a keyboard as an input apparatus; 5 denotes an indicator such as CRT, LCD, or the like; 6 denotes an interface section to control the indicator 5; 7 indicates a voltage source; and 8 denotes an interface section to control the thermal head. A stepping motor 9 controls the movement of a carriage 15 and a head motor 10 controls the operation of the head. A character generator 11 stores character patterns and a reference numeral 12 denotes a timer I to control the exciting time of the stepping motor. A reference numeral 13 denotes a timer II to control the output time of a heat pulse to the thermal head and the heat rest time. Further, reference numerals respectively follows: 14 denotes a thermal print head to having a plurality of heat generating elements, 15, a carriage on which the thermal head 14 is mounted; 16, a printer unit including the thermal head 14 and carriage 15; 17, a CPU bus to transmit addresses, data, and control signals; and 18, a thermistor to detect the temperature of the thermal head 14 and heat generating elements.

Figure 2:
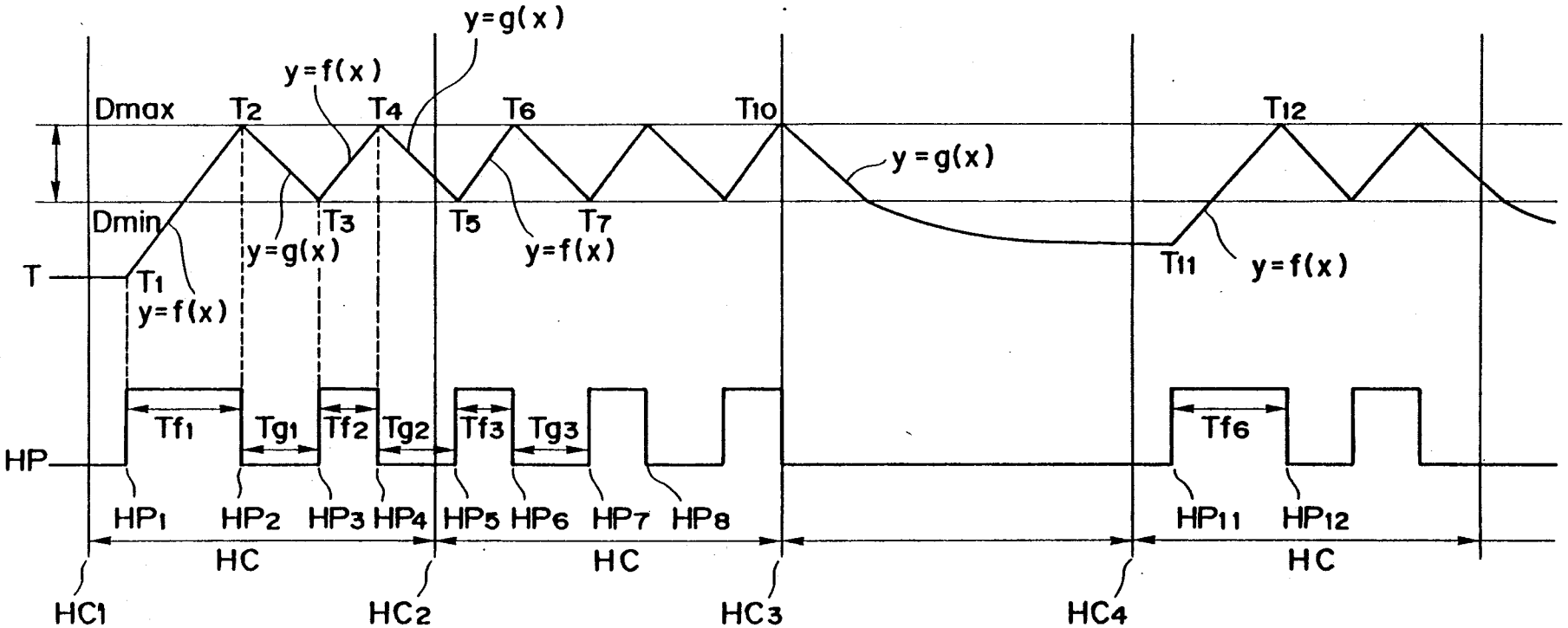
FIG. 2 is a timing chart showing the operation in the embodiment of the invention.

A timing chart of the embodiment of the invention is shown in FIG. 2.

In the diagram, $HC_1$ to $HC_2$ and $HC_2$ to $HC_3$ denote heat cycles (HC). An interruption signal to the stepping motor 9 to drive the carriage 15 is generated by the $HC_1$, $HC_2$, and $HC_3$ and the motor 9 is excited.

HP indicates a heat pulse; $HP_1$, $HP_3$, $HP_5$, . . . denote heating start positions; $HP_2$, $HP_4$, $HP_6$, . . . represent heating end positions; $Tf_1$, $Tf_2$, $Tf_3$, . . . heating times; and $Tg_1$, $Tg_2$, $Tg_3$, . . . denote heat rest times. The interruption of the heating operation is executed at the leading and trailing times of the heat pulse HP. T denotes a temperature of the heat generating element (in the embodiment, about 5° C. to 30°1 C.); $T_1$, $T_3$, $T_5$, . . . indicate temperatures at the start of the heating operation; $T_2$, $T_4$, $T_6$, . . . represent temperatures at the start of the interruption of the heating operation. $y=f(x)$ denotes a temperature increase function which indicates the relation between the heat pulse time and the heat generating element temperature which increases by outputting the heat pulses to the thermal head 14 for a predetermined time. The function $y=f(x)$ is obtained by the experiments or the like. $D_{max}$ indicates the highest value of the temperature which is suitable to print and is arrived by the temperature increase function $y=f(x)$ (in the embodiment, about 180° C. to 220° C.). $y=g(x)$ denotes a temperature decrease function which indicates the relation between the heat rest time and the temperature which decreases due to the interruption of the heating operation. The function $y=g(x)$ is obtained by the experiments or the like $D_{min}$ indicates the lowest temperature value (in the embodiment, about 80° C. to 120° C.) which is suitable for printing and is arrived by the temperature decrease function $y=g(x)$. The temperatures between $D_{max}$ and $D_{min}$ are the temperature range which is proper for printing.

When an interruption signal to the stepping motor 9 is generated in the heat cycle $HC_1$, the stepping motor 9 is excited and the carriage 15 is moved by one step. Next, when the heating operation is interrupted by the $HP_1$. the difference between the present temperature $T_1$ which has previously been detected by the thermistor 18 and the objective arrival temperature $D_{max}$ is calculated. The heat pulse time $Tf_1$ is determined by the temperature increase function $y=f(x)$ and the heat generating element 14 is heated. At this time, the heat pulse time $Tf_1$ is set into the timer II and the temperature information in the RAM 3 is also renewed to the objective arrival temperature $T_2$. After the elapse of the time $Tf_1$, the heating operation is again interrupted by the $HP_2$. In this case, the heat pulse is not generated. At this time, the temperature has reached the maximum value $D_{max}$ suitable to print. The difference between the temperature $T_2$ obtained by the temperature increase function $y=f(x)$ and the objective down arrival temperature $D_{min}$ $(=T_3)$ is calculated and the heat rest time $Tg_1$ is decided by the temperature decrease function $y=g(x)$. The rest time $Tg_1$ is set into the timer II and the temperature information is also renewed to $T_3$. After the elapse of the time $Tg_1$, the heat interruption is again generated by $HP_3$. The difference between the present temperature $T_3$ obtained by the temperature decrease function $y=g(x)$ and the objective arrival temperature $T_4$ is calculated. The heat pulse time $Tf_2$is determined by the temperature increase function f(x) and the heat generating element 14 is heated. The temperature increase function $y=f(x)$ which is used in this case is quite the same function as the foregoing function. The time $Tf_2$ is set into the timer II. After the elapse of the time $Tf_2$, the heating operation is interrupted by the $HP_4$. The heat pulse is not generated at the time of $HP_4$. In this case, the temperature $T_4$ has reached the highest temperature value $D_{max}$ which is suitable for printing.

Next, the difference between the temperature $T_4$and the objective down arrival temperature $T_5$ is calculated and the heat rest time $Tg_2$ is determined by the temperature decrease function $y=g(x)$. The temperature decrease function $y=g(x)$ which is used here is quite the same function as the foregoing function. After that, the heating operation and the rest operation are repeated by alternately using the two functions $y=f(x)$ and $y=g(x)$. The temperature information is also successively renewed. The interruption cycles $HC_2$ and $HC_3$ of the stepping motor are started for the heating and rest periods of time. The motor is excited to move the carriage one step by one. Thus, the printing is executed.

If data to be printed does not exist in the heat cycle HC, that is, in the case where all dots are the white dots, even when the heat pulse is given, the heat generating element 14 is not heated. Therefore, by previously reading the dot information, the heating operation is interrupted.

Therefore, for instance, if no print data exists as shown after the heat cycle $HC_3$, the heat rest period of time is started. However, in this case, the temperature $T_{11}$ after the elapse of the heat rest time is obtained from the preceding renewed temperature information $T_{10}$ and the heat rest time by the temperature decrease function $y=g(x)$ and is again renewed as the next temperature information.

That is, when the print data exists at the recording timing $HC_4$, the difference between the $T_{11}$ which was renewed as the temperature information and the objective set temperature $D_{max}$ is calculated. The heat pulse time $Tf_6$ is determined by the same temperature increase function $y=f(x)$ as the foregoing function and the thermal head 14 is heated.

Figure 3:
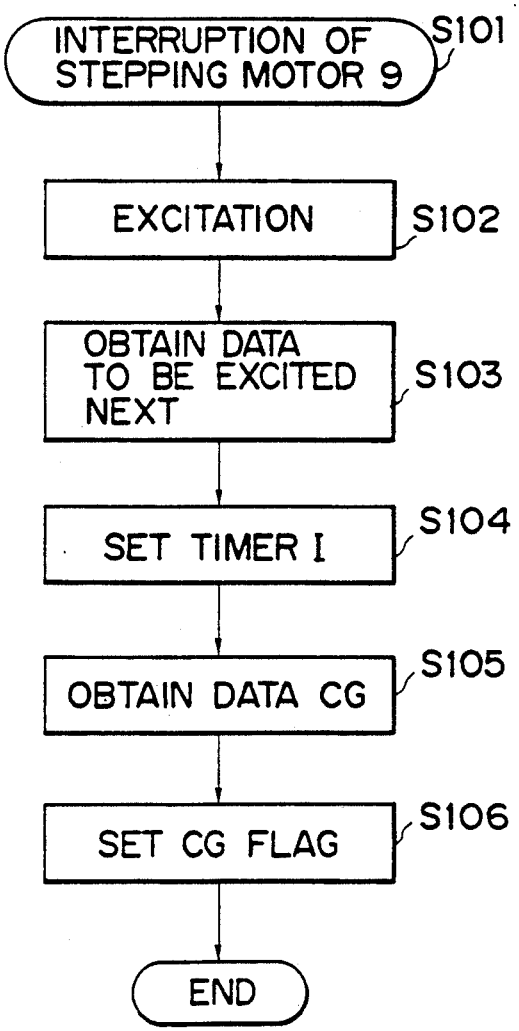
FIG. 3 is a flowchart showing an example of a control sequence for the interruption of a stepping motor in the embodiment of the invention.

FIG. 3 shows a flowchart for the interruption of the stepping motor 9. This sequence shows the operation which is executed for the interruption performed in the heat cycles $HC_1$, $HC_2$, and $HC_3$ in FIG. 2. That is, when the interruption occurs in step S101, the stepping motor is excited to rotate it in step S102. In step S103, the excitation data to be set in the next interruption is obtained. This data is used for the excitation in step S102 at the time of the next interruption. In step S104, the interruption interval time is set into the timer I. This time is equal to the heat cycle shown by $HC_1$ to $HC_2$ and $HC_2$ to $HC_3$ in FIG. 2. In step S105, data CG is obtained from the character generator 11 in FIG. 1. The data CG is the print data. When the data CG exists, a CG flag in the RAM 3 in FIG. 1 is set ON in step S106. If the data CG does not exist, the CG flag is set OFF. The stepping motor interrupting process is finished.

Figure 4:
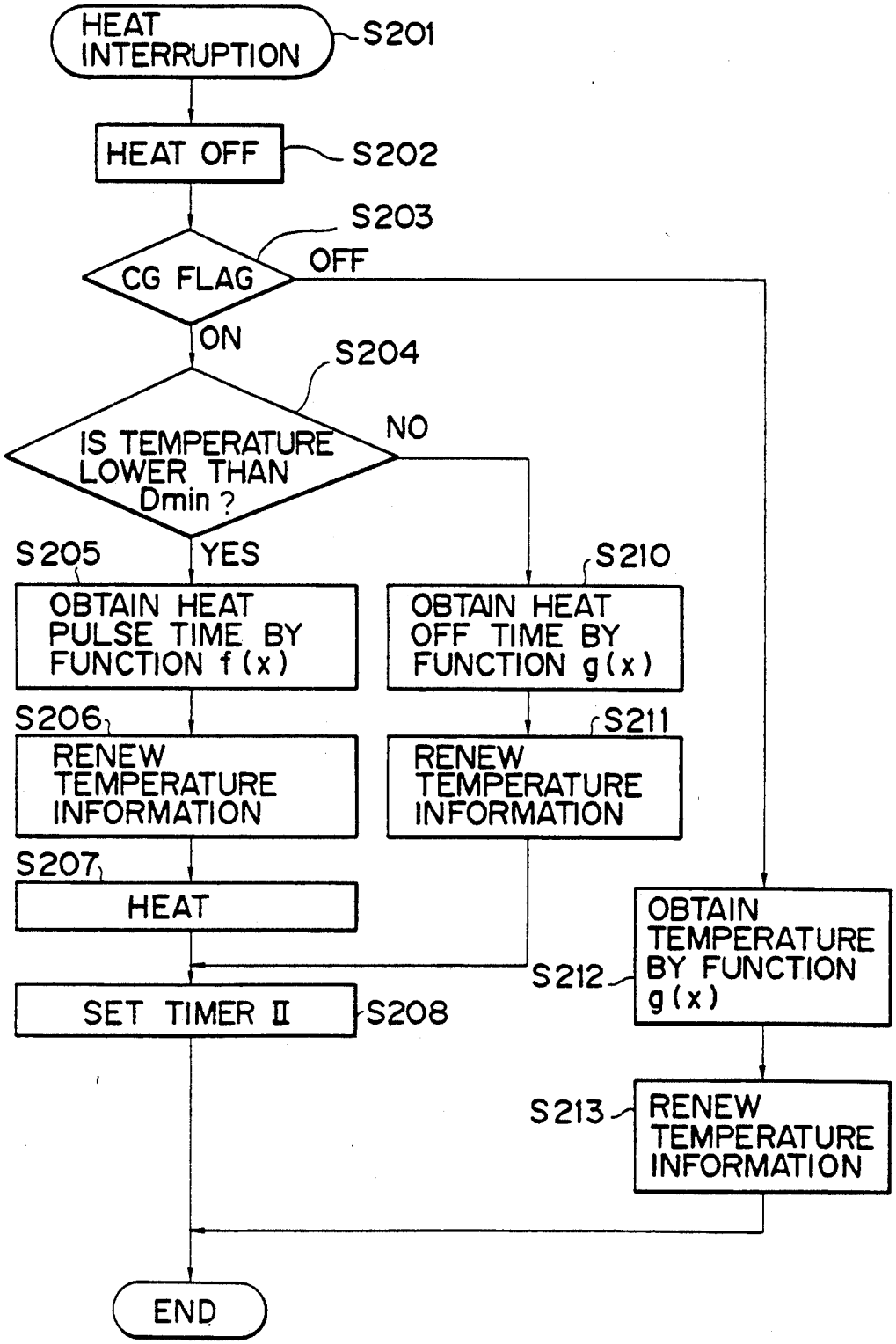
FIG. 4 is a flowchart showing an example of a control sequence for the interruption of the heating in the embodiment of the invention.

Further, a control sequence for the interruption of the heating operation will now be described with reference to a flowchart shown in FIG. 4. This sequence shows the operation which is executed for the interruption generated by the $HP_1$ to $HP_6$ or the like shown in FIG. 2.

When the heat interruption is generated in step S201, the heating operation is stopped in step S202. In step S203, a check is made to see if the CG flag has been set ON or OFF. If it is OFF, this means that data to be printed does not exist, so that the processing routine advances to step S212. If it is ON, this means that the print data exists, so that step S204 follows. is lower than the lowest temperature value $D_{min}$ which In step S204, a check is made to see if the temperature is suitable for printing or not. If it is not lower than the $D_{min}$, step S210 follows. If it is lower than the $D_{min}$ the printing operation cannot be executed unless the temperature lies within the temperature range suitable for the printing. Therefore, to raise the temperature, the heating time $T_f$ is decided by using the temperature $T_1$ of the thermistor which has previously been detected and the temperature increase function $y=f(x)$. In the example, the objective set temperature is set to the highest temperature value $D_{max}$ suitable to print. In step S206, the temperature information in the area 3A is renewed. In step S207, the heat generating element is heated for the period of time Tf.

Returning to step S204, when the temperature is equal to or higher than the lowest value $D_{min}$, that is, when the heat generating element has been heated in step S207 and the temperature has been raised up to the highest value $D_{max}$ the heating operation must be stopped. In step S210, the heat rest time Tg is determined by using the temperature decrease function $y=g(x)$. In this example, the objective set temperature is set to the lowest temperature value $D_{min}$ which is suitable to print. In step S211, the temperature information is renewed to the $D_{min}$. The heat times $T_f$ and $T_g$ determined in steps S205 and S210 are set into the timer II in step S208. Then, the heat interrupting process is finished.

Returning to step S203, when the CG flag is OFF, step S212 follows and the temperature is obtained by the temperature decrease function $y=g(x)$. At this time, the temperature value stored and the heat rest time are input as mentioned above. In step S213, the temperature information is renewed by the temperature for instance, $T_{11}$ obtained. Then, the processing routine is finished.

The renewing process of the temperature information which is executed in step S213 is performed by an output from the function $y=g(x)$ and not by the output data of the thermistor. That is, during the interrupting operation of the print sequence, the renewing processes of the temperature information are all executed in accordance with the temperature function $y=g(x)$.

Figure 5:
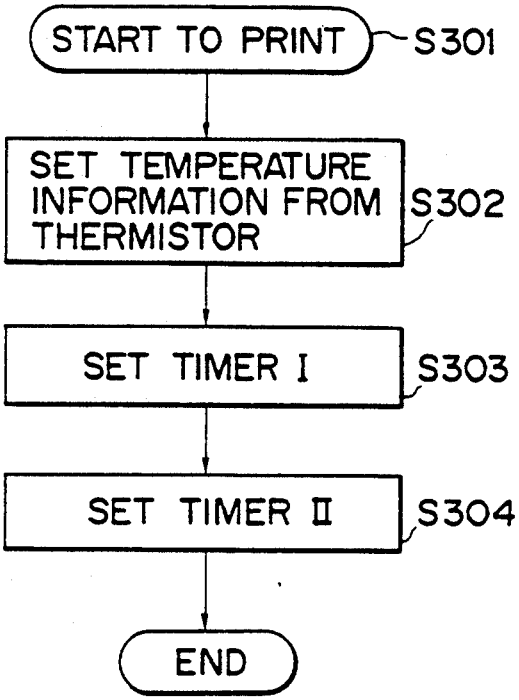
FIG. 5 is a flowchart showing an example of a control sequence when the printing operation is started in the embodiment of the invention.

FIG. 5 shows a flowchart for the control procedure to start the printing operation. In step S301, when the print start processing section is activated, the temperature of the heat generating element is measured by the thermistor 18 and the temperature information is set into the area 3A in the RAM 3 in step S302. Next, in step S303, the interruption timer I of the stepping motor is set. In step S304, the heat interruption timer II is set and the processing routine is finished. The temperature is detected by the thermistor 18 only when the printing operation is started.

Figure 6:
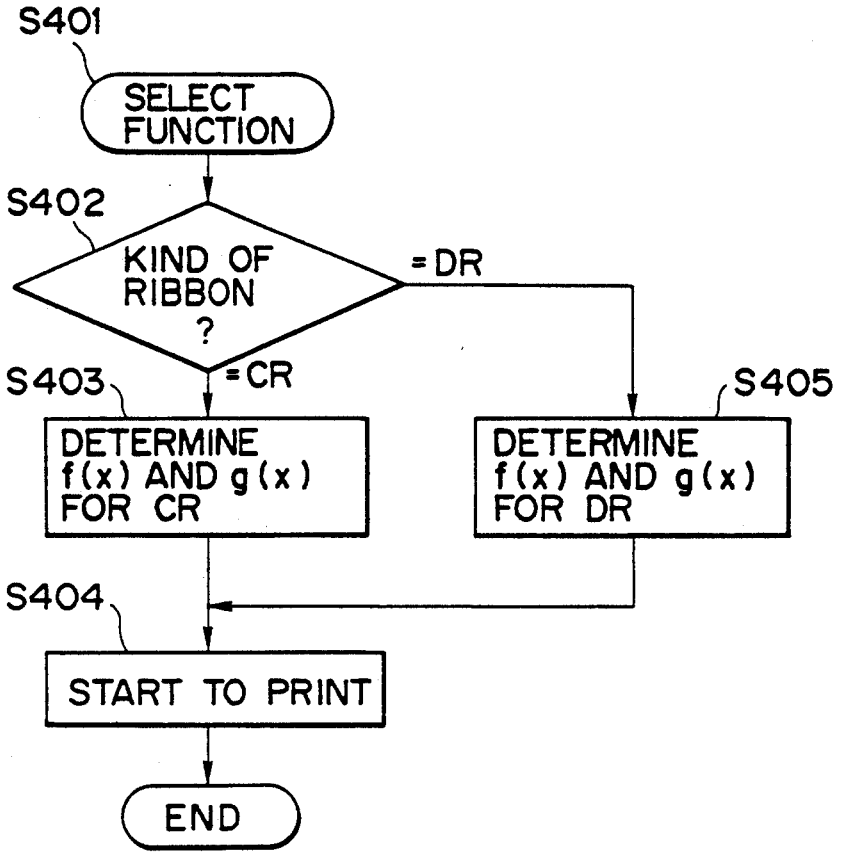
FIG. 6 is a flowchart showing an example of a control sequence in the case where the invention is applied to a printer having a plurality of ribbons.

An example of a control procedure in the case where the invention is applied to a printer having a plurality of ribbons is shown as another embodiment of the invention in a flowchart of FIG. 6. In this case, the function is set every ribbon which is used. In step S401, the process is started. In step S402, the kind of ribbon which is used is checked. If it is CR (Correctable Ribbon), in step S403, the functions $y=f(x)$ and $y=g(x)$ for the correctable ribbon are respectively determined. If it is DR (Dual Color Ribbon), in step S405, the functions $y=f(x)$ and $y=g(x)$ for the dual-color ribbon are respectively decided and step S404 follows. In step S404, the printing operation is started as mentioned above on the basis of the functions which were respectively determined in step S403 or S405 and the processing routine is finished.

Figure 7:
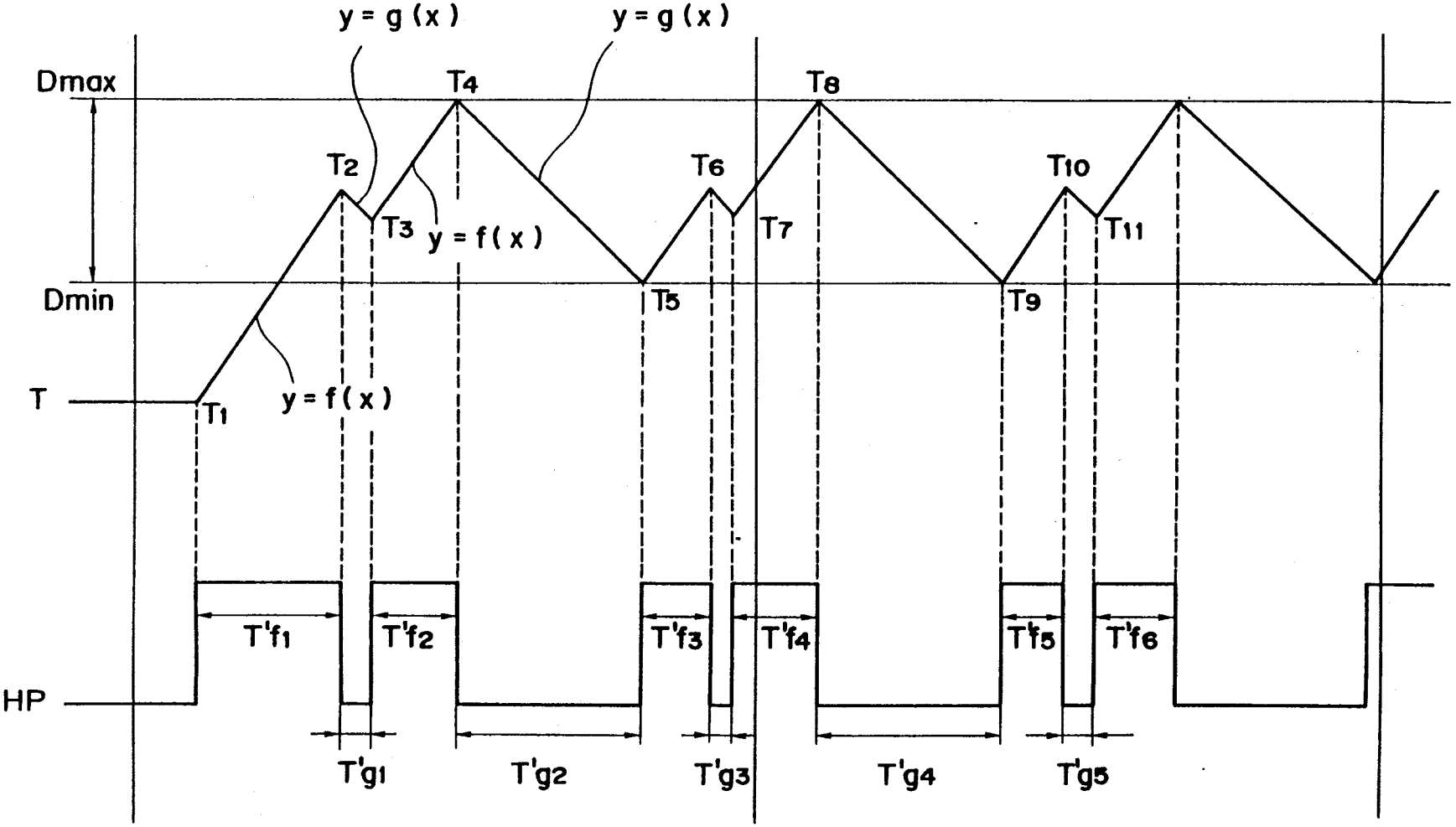
FIG. 7 is a timing chart showing the operation in another embodiment of the invention.

Another embodiment of the invention will now be described on the basis of a timing chart shown in FIG. 7.

In the embodiment, the temperature is increased by two steps. That is, the generation of the heat pulse HP is started from the temperature $T_1$ at the start of the printing in accordance with the temperature increase function $y=f(x)$ and the heat pulses are continuously generated for the time $Tf_1$ until the temperature becomes the central value $T_2$ in the temperature range suitable to print. Therefore, the generation of the heat pulses is stopped for the time $Tg_1$ of tens of msec. and the temperature is reduced until $T_3$. The heat generating element is again heated for the time $Tf_2$ until the temperature becomes the highest temperature value ($D_{max}=T_4$) suitable to print. In a manner similar to the above embodiment, the heating operation is stopped for the time $Tg_2$ in accordance with the temperature decrease function $y=g(x)$.

In this manner, by dividing the heating operation into two operations while avoiding that the heat generating element is continuously heated, the life of the heat generating head 14 can be prolonged.

Figure 8:
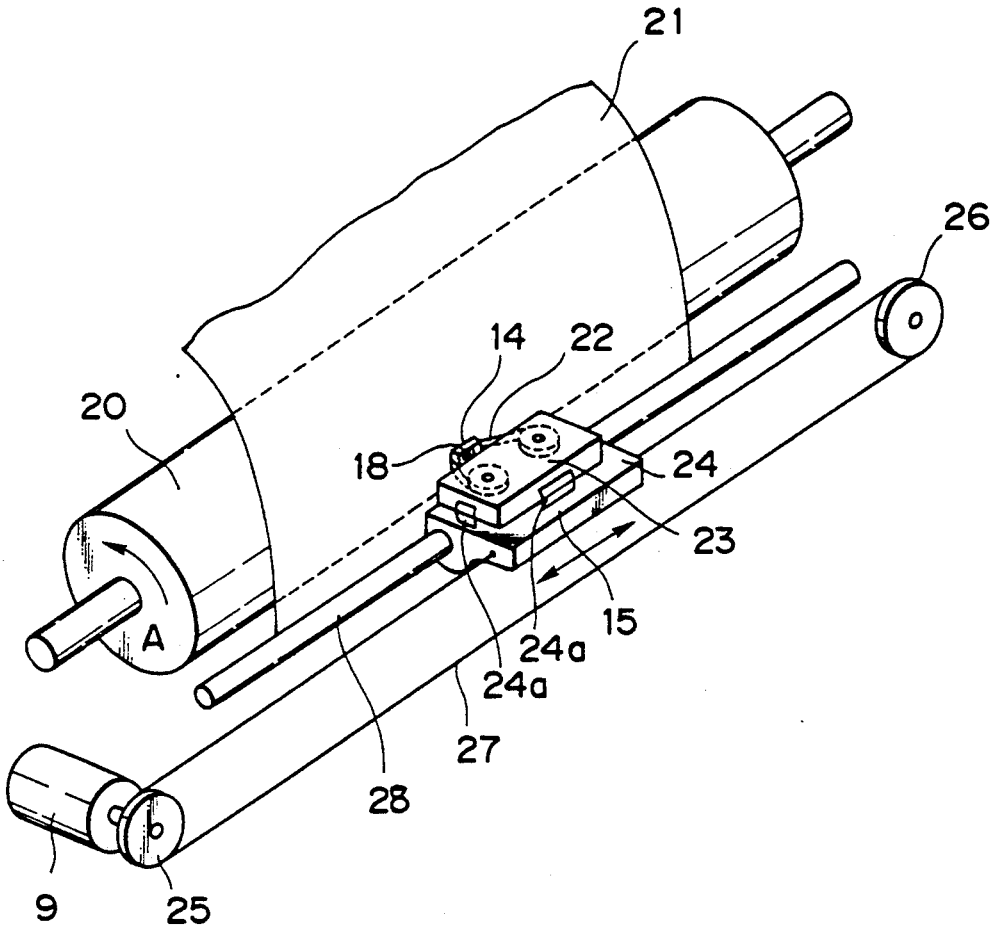
FIG. 8 is a perspective view of a thermal transfer printer to which the heat control of the invention is applied.

The thermal transfer copying printer to perform the foregoing heat control will now be described with reference to FIG. 8.

In the diagram, reference numeral 20 denotes a platen roller. A recording paper 21 is conveyed by rotating the platen roller 20 in the direction shown by an arrow A (counterclockwise). On the other hand, when the thermal head 14 is put down and presses an ink ribbon 22 onto the recording paper 21, the recording paper 21 is maintained at a predetermined position by the platen roller 20. On the other hand, the carriage 15 is movably attached along a guide shaft 28 attached in parallel with the platen roller 20. The carriage 15 has a cassette loading section 24 for attaching the thermal head 14 so that it can be put up and down and for detachably loading an ink ribbon cassette 23 having therein the ink ribbon 22. A stop member 24*a* is provided to fixedly hold the cassette 23 onto the loading section 24. The carriage 15 is reciprocated by a driving system comprising: the stepping motor 9; a drive pulley 25; a driven pulley 26; and a belt 27 which is wound around the pulleys 25 and 26 and is fixed to the carriage 15. The thermal head 14 has a plurality of heat generating elements and is swingably attached between a down position to press the platen roller 20 through the ink ribbon 22 and an up position away from the down position.

In the printer of the embodiment, for the recording paper 21 backed up around the platen roller 20, the recording is executed by the thermal head 14 attached to the carriage 15.

In the embodiment, the thermal transfer copying printer has been described as an example of the recording apparatus. However, the invention is not limited to such a printer. For instance, the invention can be also applied to what is called a thermal recording apparatus for recording an image by generating a color from a thermal sheet by applying the heat thereto, what is called an ink jet printer for recording an image by ejecting an ink droplet by applying the heat thereto, or the like. Therefore, the recording heads include the thermal head mentioned in the above embodiment, ink jet head, and the like. In the embodiment, on the other hand, an example in which the thermistor is provided on the back side of the base plate of the head has been described. However, the invention is not limited to such an example. For instance, the thermistor can be also attached to a base body of the apparatus or the like. In such a case, the thermistor detects the ambient air temperature. On the other hand, the recording condition is determined by the kind of ribbon, head voltage, kind of recording paper, and the like.

As will be obvious from the above description, according to the foregoing embodiment, for the heat control of the heat generating elements, the first function to raise the temperature and the second function to decrease the temperature are provided and the temperature information is updated, thereby controlling the heating time and the heat rest time. Therefore, the temperature of the heat generating elements can be always held within a temperature range suitable to print and the clear printed result can be always obtained. On the other hand, since there is no need to measure the temperature of the heat generating element every printing operation, the printing operation can be executed at a high speed.

As mentioned above, according to the invention, a recording apparatus which can obtain a clear recording image can be provided.

I claim:

1. A recording apparatus for recording onto a recording medium comprising:

a recording head for recording on said recording medium, said recording head having a plurality of heat generating elements for generating heat;

detecting means for detecting a temperature of said heat generating elements before recording is started in a first recording operation; and controlling means for controlling energization and deenergization of each of said heat generating elements based on the following indications the temperature detected by said detecting means, a first anticipative temperature of each of said heat generating elements calculated using a predetermined first function, each of said heat generating elements being energized to produce heat until reaching the first anticipative temperature, thereby controlling a heating time of said given heat generating elements, and a second anticipative temperature of each of said heat generating elements calculated using a predetermined second function, said given heat generating element being deenergized to cool until reaching the second anticipative temperature, thereby controlling a cooling time of each of said heat generating elements, wherein only the first anticipative temperature is calculated by using said detected temperature with said predetermined first function.

2. An apparatus according to claim 1, wherein said predetermined first function is obtained by experimentation and indicates a relation between an energization time of a heat generating element and a temperature of a heat generating element which increases during energization of the heat generating element for a predetermined time and said predetermined second function is obtained by experimentation and indicates a relation between a deenergization time of a heat generating element and a temperature of a heat generating element which decreases during deenergization of the heat generating element.

3. An apparatus according to claim 1, wherein said controlling means controls energization and deengerization taking into account at least one of a plurality of recording conditions, said recording conditions including a kind of an ink ribbon, a king of a recording paper, and a head voltage.

4. A recording apparatus according to claim 1, wherein said first predetermined function indicates an extent of a rise in the temperature of the heat generating element which results from an application of a predetermined duration heat pulse to said recording head, said first predetermined function being experimentally determined.

5. A recording apparatus according to claim 1, wherein said second predetermined function indicates an extent of a decrease in the temperature of the heat generating element which results from a termination of heat generation, said first predetermined function being experimentally determined.

6. A recording apparatus according to claim 1, wherein said apparatus is an ink jet printer for discharging an ink to record.

7. A thermal transfer copying printer for printing by causing a print head to generate a heat by supplying a current thereto, wherein said printer has detecting means for detecting a temperature of said print head, and control means for, based on a result of a detection by said detecting means, heating the print head for a predetermined time in accordance with a predetermined first function for raising temperature and, after elapse of said predetermined time, stopping the heating operation for a predetermined time in accordance with a predetermined second function for lowering temperature.

8. A printer according to claim 7, wherein said first and second functions are stored in a temperature function table in ROM.

9. A recording method for recording onto a recording medium comprising the steps of:

providing a recording head having a plurality of heat generating elements;

detecting a temperature of a given one of said heat generating elements before the recording is started in a first recording operation; and controlling energization and deenergization of said given one of said heat generating elements in accordance with the detected temperature, a first anticipative temperature of said one of said heat generating elements calculated using a predetermined first function, said given one of said heat generating elements being energized to produce heat until reaching the first anticipative temperature, thereby controlling a heating time of said given one of said heat generating elements, and a second anticipative temperature of said given one of said heat generating elements calculated using a predetermined second function, said given one of said heat generating elements being deenergized to cool until reaching the second anticipative temperature, thereby controlling a cooling time of said given one of said heat generating elements, wherein only the first anticipative temperature is calculated by using said detected temperature with said predetermined first function.

10. A method according to claim 9, wherein said controlling of energization and deenergization takes into account at least one of a plurality of recording conditions, said recording conditions including a kind of an ink ribbon, a king of a recording paper, and a head voltage.

11. A recording method according to claim 9, wherein said first predetermined function indicates an extent of a rise in the temperature of said given one of said heat generating element which results from an application of a predetermined duration heat pulse to said recording head, said first predetermined function being experimentally determined.

12. A recording method according to claim 9, wherein said second predetermined function indicates an extent of a decrease in said given temperature of the heat generating element results from a termination of heat generation, said first predetermined function being experimentally determined.

13. A recording method according to claim 9, wherein said method is an ink jet recording method for discharging an ink to record.

14. A recording apparatus for performing recording using an ink jet recording head for discharging ink from an orifice, said ink jet head having a plurality of heat generating elements for generating heat, comprising:

detecting means for detecting a temperature of said heat generating elements before recording is started in a first recording operation; and controlling means for controlling energization and deenergization of each of said heat generating elements in accordance with the following properties associated with a given said heat generating element the temperature detected by said detecting means, a first anticipative temperature of said given heat generating elements calculated using a predetermined first function, each of said heat generating elements being energized to produce heat until reaching the first anticipative temperature, thereby controlling a heating time of each of said heat generating elements, and a second anticipative temperature of each of said heat generating elements calculated using a predetermined second function, each of said heat generating elements being deenergized to cool until reaching the second anticipative temperature, thereby controlling a cooling time of each of said heat generating elements, wherein only the first anticipative temperature is calculated by using said detected temperature with said predetermined first function.

* * * * *

UNITED STATES PATENT AND TRADEMARK OFFICE

CERTIFICATE OF CORRECTION

PATENT NO. : 5,331,340

DATED : July 19, 1994

INVENTOR(S) : AKIHIKO SUKIGARA

It is certified that error appears in the above-identified patent and that said Letters Patent is hereby corrected as shown below:

IN THE DRAWINGS

Sheet 1 of 8, "TEMPARATURE" (both occurrences) should read --TEMPERATURE--.

COLUMN 1

Line 36, "exists" should read --exist--.
Line 61, "in heat" should read --of heat--.

COLUMN 2

Line 4, "the" (first occurrence) should be deleted.
Line 7, "head" (second occurrence) should be deleted.

COLUMN 3

Line 24, "respectively" should read --respectively are as--.
Line 25, "to" should be deleted.
Line 26, "elements," should read --elements;--.
Line 45, "30°1 C.);" should read --30°C.);--.
Line 63, "like" should read --like.--.

COLUMN 4

Line 4, "$HP_1$." should read --$HP_1$,--.
Line 10, "14" should be deleted.
Line 28, "$Tf_2$is" should read --$Tf_2$ is--.
Line 30, "14" should be deleted.
Line 38, "$T_4$and" should read --$T_4$ and--.
Line 54, "14" should be deleted.

--

UNITED STATES PATENT AND TRADEMARK OFFICE

CERTIFICATE OF CORRECTION

PATENT NO. : 5,331,340

DATED : July 19, 1994

INVENTOR(S) : AKIHIKO SUKIGARA

It is certified that error appears in the above-identified patent and that said Letters Patent is hereby corrected as shown below:

COLUMN 5

Line 33, "is lower than" should be deleted.
Line 34, "the lowest temperature value $D_{min}$ which" should be deleted.
Line 35, "is suitable" should read --is lower than the lowest temperature value $D_{min}$ which is suitable--.

COLUMN 6

Line 59, "head 14" should read --element--.

COLUMN 7

Line 54, "element" should read --elements--.

COLUMN 8

Line 3, "indications" should read --conditions:--.
Line 6, "elements" should read --elements being--.
Line 10, "of" should read --of each of-- and "given" should be deleted.
Line 13, "elements" should read --elements being--.
Line 14, "function," should read --function, each of-- and "given" should be deleted.
Line 15, "element" should read --elements--.
Line 35, "deengeri-" should read --deenergi- --.
Line 38, "king" should read --kind--.

--

UNITED STATES PATENT AND TRADEMARK OFFICE

CERTIFICATE OF CORRECTION

PATENT NO. : 5,331,340

DATED : July 19, 1994

INVENTOR(S) : AKIHIKO SUKIGARA

It is certified that error appears in the above-identified patent and that said Letters Patent is hereby corrected as shown below:

COLUMN 9

Line 9, "the" should be deleted.
Line 15, "said" should read --said given--.
Line 16, "elements" should read --elements being--.
Line 24, "elements" should read --elements being--.
Line 38, "king" should read --kind--.
Line 43, "element" should read --elements--.

COLUMN 10

Line 6, "said given temperature of the" should read --the temperature of said given one of said--.
Line 7, "element" should read --elements--.
Line 27, "elements" should read --element--.
Line 34, "elements" should read --elements being--.

Signed and Sealed this

Thirteenth Day of December, 1994

Attest:

Bruce Lehman

BRUCE LEHMAN

Attesting Officer

Commissioner of Patents and Trademarks